US011165157B2

(12) United States Patent
Ikeda et al.

(10) Patent No.: US 11,165,157 B2
(45) Date of Patent: Nov. 2, 2021

(54) ANTENNA DEVICE

(71) Applicants: DENSO CORPORATION, Kariya (JP); SOKEN, INC., Nisshin (JP); NATIONAL UNIVERSITY CORPORATION KYOTO INSTITUTE OF TECHNOLOGY, Kyoto (JP)

(72) Inventors: Masakazu Ikeda, Nisshin (JP); Yuji Sugimoto, Nisshin (JP); Hiroaki Kuraoka, Kariya (JP); Shiro Koide, Kariya (JP); Tetsuya Ueda, Kyoto (JP); Kohei Enomoto, Kyoto (JP)

(73) Assignees: DENSO CORPORATION, Kariya (JP); SOKEN, INC., Nisshin (JP); National University Corporation Kyoto Institute of Technology, Kyoto (JP)

( * ) Notice: Subject to any disclaimer, the term of this patent is extended or adjusted under 35 U.S.C. 154(b) by 610 days.

(21) Appl. No.: 16/079,948

(22) PCT Filed: Feb. 13, 2017

(86) PCT No.: PCT/JP2017/005055
§ 371 (c)(1),
(2) Date: Aug. 24, 2018

(87) PCT Pub. No.: WO2017/145831
PCT Pub. Date: Aug. 31, 2017

(65) Prior Publication Data

US 2021/0184356 A1 Jun. 17, 2021

(30) Foreign Application Priority Data

Feb. 26, 2016 (JP) ..... JP2016-035988

(51) Int. Cl.
*H01Q 9/04* (2006.01)
*H01Q 1/48* (2006.01)

(52) U.S. Cl.
CPC ..... *H01Q 9/0421* (2013.01); *H01Q 1/48* (2013.01); *H01Q 9/0457* (2013.01)

(58) Field of Classification Search
CPC ..... H01Q 9/04; H01Q 9/0421; H01Q 9/0457; H01Q 1/48; H01Q 9/28; H01Q 13/08
See application file for complete search history.

(56) References Cited

U.S. PATENT DOCUMENTS 7,911,386 B1 3/2011 Itoh et al.
2005/0116867 A1* 6/2005 Park ..... H01Q 9/0457 343/725

(Continued)

FOREIGN PATENT DOCUMENTS

JP 2007097115 A 4/2007

*Primary Examiner* — Hoang V Nguyen
(74) *Attorney, Agent, or Firm* — Harness, Dickey & Pierce, P.L.C.

(57) ABSTRACT

An antenna device includes a ground plate, a patch portion disposed parallel to the ground plate with a particular spacing, a plurality of short circuit portions that electrically connect the patch portion to the ground plate, and a loop portion which is a loop shaped conductor member at a particular spacing from an outer edge portion of the patch portion. The patch portion has an area which forms an electrostatic capacitance that causes parallel resonance with an inductance provided by the short circuit portions at a particular target frequency. The loop portion is formed with a perimeter length which is an integral multiple of the wavelength of radio waves at the target frequency. A feed point is disposed on the loop portion, and current is supplied to the patch portion through the loop portion.

13 Claims, 12 Drawing Sheets

(56) References Cited

U.S. PATENT DOCUMENTS

2010/0194663 A1* 8/2010 Rothwell ..... H01Q 9/0407
343/876
2014/0266959 A1* 9/2014 Xue ..... H01Q 1/38
343/848

* cited by examiner

ANTENNA DEVICE

CROSS-REFERENCE TO RELATED APPLICATIONS

This application is a U.S. National Phase Application under 35 U.S.C. 371 of International Application No. PCT/JP2017/005055 filed on Feb. 13, 2017 and published in Japanese as WO/2017/145831 A1 on Aug. 31, 2017. This application is based on and claims the benefit of priority from Japanese Patent Application No. 2016-035988 filed on Feb. 26, 2016. The entire disclosures of all of the above applications are incorporated herein by reference.

TECHNICAL FIELD

The present disclosure relates to an antenna device having a flat plate structure.

BACKGROUND ART

Conventionally, as disclosed in Patent Literature 1, there are antenna devices which include a flat plate shaped metal conductor (hereinafter referred to as a ground plate) functioning as a ground, a flat plate shaped metal conductor (hereinafter referred to as a patch portion) positioned so as to face the ground plate, and a short circuit portion that electrically connects the ground plate with the patch portion. A power feeding point is provided at an arbitrary position on the patch portion.

In this type of antenna device, parallel resonance is generated due to an electrostatic capacitance formed between the ground plate and the patch portion and an inductance included in the short circuit portion. This parallel resonance is generated at a frequency corresponding to that electrostatic capacitance and inductance. The electrostatic capacitance formed between the ground plate and the patch portion is determined according to the area of the patch portion. Therefore, by adjusting the area of the patch portion, it is possible to set a transmission and reception frequency of the antenna device (hereinafter referred to as target frequency) to a desired frequency.

Further, Patent Literature 1 discloses a configuration in which a plurality of patch units each including a patch portion and a short circuit portion are arranged. By providing a plurality of patch units, it is possible to operate the antenna device at a plurality of frequencies.

PRIOR ART LITERATURES

Patent Literature

Patent Literature 1: U.S. Pat. No. 7,911,386 B

SUMMARY OF THE INVENTION

In recent years, the frequency bands of wireless communication standards for cellular phones has diversified. Accordingly, for antenna devices, there is a demand for widening the operation band. According to the configuration of the antenna device of Patent Literature 1, by arranging a plurality of patch units, it is possible to operate the antenna device at a plurality of discrete frequencies. However, this does not widen the operation band itself. It should be noted that operation band here means a frequency band usable for transmission and reception of signals.

According to the present disclosure, it is possible to provide an antenna device usable in a wider frequency band.

In the present disclosure, an antenna device includes a ground plate which is a flat plate shaped conductor member, a patch portion which is a flat plate shaped conductor member disposed in parallel with the ground plate to face the ground plate, the patch portion being spaced away from the ground plate by a particular spacing, a plurality of short circuit portions that electrically connects the patch portion to the ground plate, and a loop portion which is a loop shaped conductor member arranged on a plane parallel to the ground plate so as to be spaced away from an outer edge portion of the patch portion by a particular spacing, where a feed point connected to a feed line is disposed in the loop portion, and the patch portion has an area which forms an electrostatic capacitance that causes parallel resonance with an inductance provided by the short circuit portions at a particular target frequency.

With the above configuration, the area of the patch portion is an area that forms the electrostatic capacitance that parallel resonates at the target frequency with the inductance provided by the short circuit portions. For this reason, parallel resonance occurs due to energy exchange between the inductance and the electrostatic capacitance at the target frequency, and an electric field perpendicular to the ground plate and the patch portion is generated between the ground plate and the patch portion. This vertical electric field propagates from the short circuit portions toward the outer edge portion of the patch portion, and the vertical electric field becomes a vertically polarized electric field at the outer edge portion of the patch portion and is radiated into space. Further, a current is supplied to the patch portion via the loop portion.

Accordingly, an antenna device having the above configuration can transmit a radio wave at the target frequency, and its directivity has the same degree of gain with respect to all directions of a plane parallel to the ground plate. Further, due to reversibility of transmission and reception, according to the above configuration, radio waves at the target frequency can be received.

In addition, the above described antenna device includes a plurality of short circuit portions. The plurality of short circuit portions function so as to virtually divide the patch portion into a plurality of regions at frequencies around the target frequency. As a result, at a certain frequency near the target frequency, parallel resonance occurs due to the electrostatic capacitance provided by a region of a part of the patch portion. That is, according to the above configuration, the antenna device easily operates even at frequencies near the target frequency, and the operation band is expanded as a whole. In other words, the antenna device can be used in a wider frequency band.

EMBODIMENTS FOR CARRYING OUT INVENTION

Figure 1:
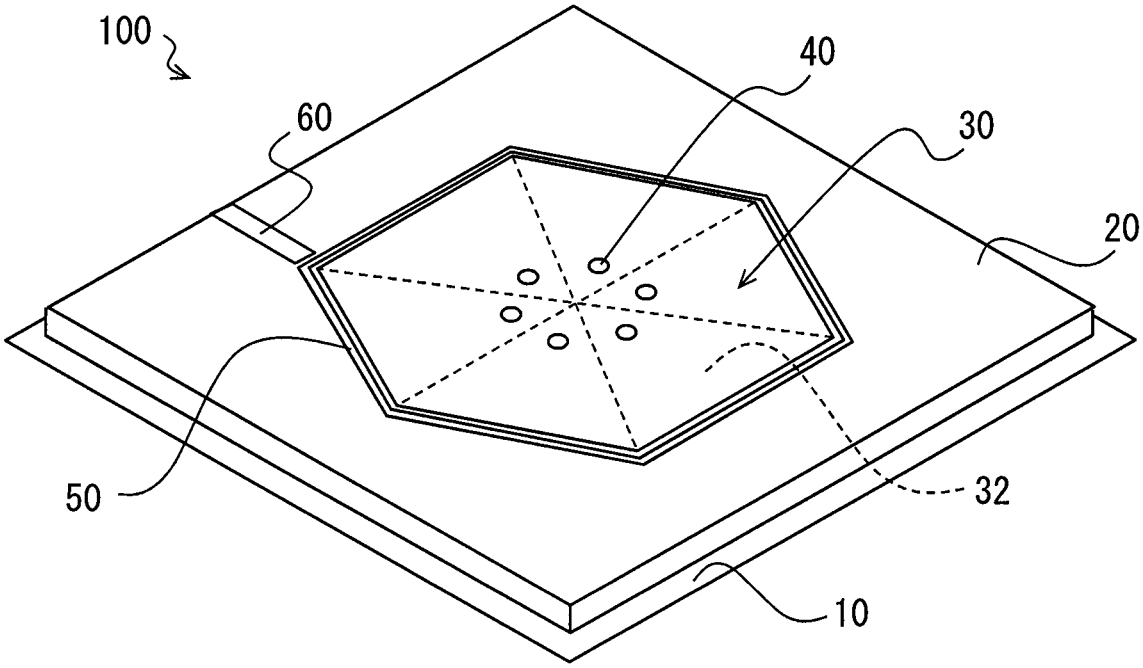
FIG. 1 is an external perspective view of an antenna device 100.
Figure 2:
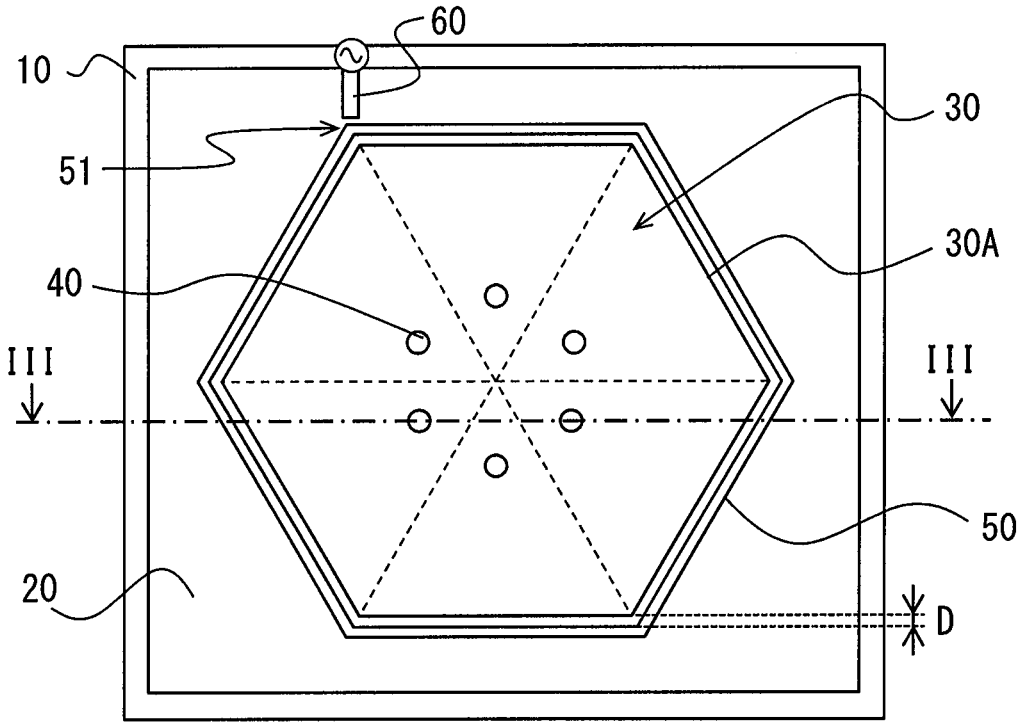
FIG. 2 is a top view of an antenna device 100.
Figure 3:
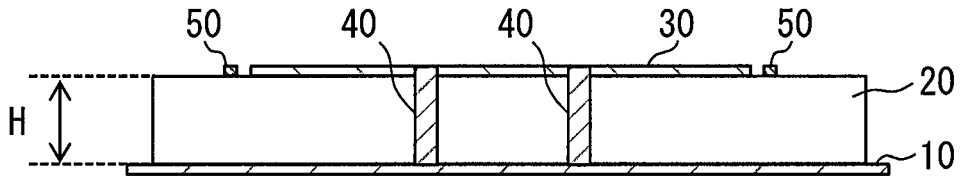
FIG. 3 is a cross-sectional view of an antenna device 100 taken along the line III-III shown in FIG. 2.

Hereinafter, embodiments of the present disclosure will be described with reference to the drawings. FIG. 1 is an external perspective view showing an example of an outline configuration of an antenna device 100 according to the present embodiment. Further, FIG. 2 is a top view of the antenna device 100. FIG. 3 is a cross-sectional view of the antenna device 100 taken along the line III-Ill shown in FIG. 2.

The antenna device 100 is configured to transmit and receive radio waves at a predetermined target frequency. Of course, as an alternative embodiment, the antenna device 100 may be used for only one of transmission or reception. The target frequency may be designed as appropriate, and in this disclosure a frequency of 2650 MHz is used as an example. The antenna device 100 can transmit and receive not only radio waves at the target frequency, but also radio waves with frequencies within a predetermined range above and under the target frequency. For the sake of convenience, hereinafter, the frequency band at which the antenna device 100 can transmit and receive is also described as an operation band.

The antenna device 100 is connected to a wireless device via, for example, a coaxial cable, and signals received by the antenna device 100 are sequentially output to the wireless device. In addition, the antenna device 100 converts an electric signal input from the wireless device into a radio wave and radiates it into space. The wireless device uses signals received by the antenna device 100, and also supplies high-frequency power corresponding to transmission signals to the antenna device 100.

In the present embodiment, it is assumed that the antenna device 100 and the wireless device are connected by a coaxial cable, but it is also possible to connect them by using a feeder cable or other well-known communication cables (including wires and the like). In addition to coaxial cables, the antenna device 100 and the wireless device may be connected via a well-known matching circuit, a filter circuit, or the like.

Hereinafter, a specific configuration of the antenna device 100 will be described. As shown in FIGS. 1 to 3, the antenna device 100 includes a ground plate 10, a support portion 20, a patch portion 30, a short circuit portion 40, a loop portion 50, and a feed line 60.

The ground plate 10 is a square plate (here, plate may also refer to a foil etc.) made of a conductor such as copper. The ground plate 10 is electrically connected to the outer conductor of the coaxial cable and provides the ground potential (in other words, ground) in the antenna device 100. The shape of the ground plate 10 is not limited to a square shape, as long as the ground plate 10 is larger than the patch portion 30. For example, the ground plate 10 may have a rectangular shape, some other polygonal shape, or a circular shape (including an elliptic shape). Of course, the ground plate 10 may also have a shaped formed of a combination of straights portion and curved portions.

The support portion 20 is a plate shaped member having a particular height H (see FIG. 3) and is made of an electrically insulating material such as resin. The support portion 20 is a member for positioning the ground plate 10 and the plat shaped patch portion 30 such that their surface portions face each other with a particular spacing H therebetween. For convenience, the surface of the support portion 20 on which the patch portion 30 is disposed is referred to as a patch surface, and the surface of the support portion 20 on which the ground plate 10 is disposed is referred to as a ground plate surface.

The shape of the support portion 20 is not limited to a plate shape, as long as the support portion 20 fulfills the above-described role. For example, the support portion 20 may be a plurality of posts that support the ground plate 10 and the patch portion 30 so as to face each other with the particular spacing H therebetween. Further, in the present embodiment, the gap between the ground plate 10 and the patch portion 30 is filled with resin (i.e., the support portion 20), but the present embodiment is not limited to this configuration. Instead, the gap between the ground plate 10 and the patch portion 30 may be hollow or a vacuum, or may be filled with a dielectric having a particular dielectric ratio. Furthermore, the exemplary structures described above may be combined with each other as well.

The patch portion 30 is a regular hexagonal shaped plate (here, plate may also refer to a foil etc.) made of a conductor such as copper. The patch portion 30 is arranged so as to be parallel (here, parallel may also refer to substantially parallel) with the ground plate 10 via the support portion 20. Here, as an example, the shape of the patch portion 30 is a regular hexagon. However, other examples for the shape of the patch portion 30 include a rectangular shape or other shapes (for example, a circle, an octagon, etc.). The patch portion 30 may have a line symmetrical shape or a point symmetrical shape, or may have a shape based on these shapes. Here, a shape based on a certain shape refers to, for example, a shape in which the edge portion has a meandering shape, a shape in which notches are cut out in the edge portion, a shape in which a corner portion is rounded, or the like. Modified examples of the shape of the patch portion 30 will be described later.

The patch portion 30 and the ground plate 10 are arranged to face each other, thereby functioning as a capacitor that forms an electrostatic capacitance corresponding to the area of the patch portion 30. The area of the patch portion 30 is an area that forms an electrostatic capacitance that parallel resonates at the target frequency with an inductance formed by the short circuit portion 40 which is described later.

In the present embodiment, a concept of six sub patch portions 31 obtained by virtually dividing the patch portion 30 into six parts is introduced and handled. Each of the plurality of sub patch portions 31 is an individual region obtained by dividing the patch portion 30 with lines connecting each vertex on an outer edge portions 30A of the patch portion 30 to a center of the patch portion 30 (hereinafter, referred to as a patch center point). The dotted lines on the patch portion 30 shown in FIGS. 1 and 2 shows the boundary lines of the sub patch portions 31. Further, a patch center point 30C corresponds to the centroid of the patch portion 30. In particular, the patch center point 30C in this embodiment corresponds to a point equidistant from every vertex forming a regular hexagon.

The short circuit portion 40 is an electrically conductive member which is electrically connected to the patch portion 30 and the ground plate 10. The short circuit portion 40 may be implemented as a conductive pin (hereinafter referred to as a short pin). Depending on the thickness of the short pin, the inductance of the short circuit portion 40 may be adjusted.

Figure 4:
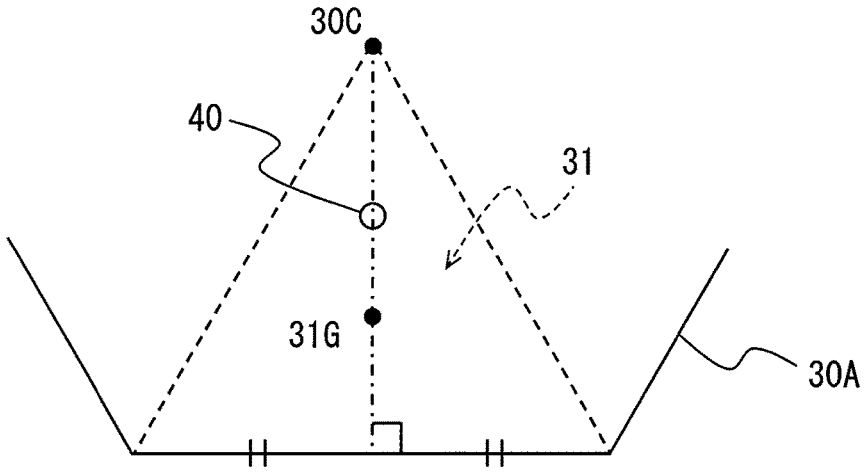
FIG. 4 is a diagram for describing the arrangement of a short circuit portion 40 in a sub patch portion 31.

The short circuit portion 40 is provided at a plurality of locations in the patch portion 30. Specifically, the short circuit portion 40 is provided in each of the plurality of sub patch portions 31. As shown in FIG. 4, the position where the short circuit portion 40 is provided in each sub patch portion 31 is preferably arranged linearly from the patch center point 30C toward a center 31G of that sub patch portion 31 (hereinafter, sub patch center point).

FIG. 4 is an enlarged view of an area around a particular sub patch portion 31. In FIG. 4, illustrations of the loop portion 50 etc. are omitted. The sub patch center point 31G corresponds to the centroid of the sub patch portion 31. Since the sub patch portion 31 is an isosceles triangle, the sub patch center point 31G is a point that internally divides the perpendicular bisector extending from the patch center point 30C toward the outer edge portion 30A of the patch portion 30 into 2:1 ratio.

The distance from the patch center point 30C to the short circuit portion 40 may be designed as appropriate. By adjusting the distance from the patch center point 30C to the short circuit portion 40, the inductance provided by the short circuit portion 40 may be adjusted. A desired inductance may be obtained by adjusting the thickness of a short pin acting as the short circuit portion 40 in accordance with the distance from the patch center point 30C to the short circuit portion 40.

Further, the short circuit portion 40 is not necessarily required to be disposed on a straight line (hereinafter referred to as a sub patch center line) from the patch center point 30C to the sub patch center point 31G. When the short circuit portion 40 is disposed at positions other than on the sub patch center line, directivity deviation occurs according to the amount of deviation from the sub patch center line. The short circuit portion 40 may be arranged at a position offset from the sub patch center line as long as the deviation in directivity falls within a predetermined allowable range.

The loop portion 50 is a loop-shaped conductor member. The loop portion 50 is formed on the patch surface of the support portion 20 at a particular spacing D away from the outer edge portion 30A of the patch portion 30. The perimeter length of the loop portion 50 is designed to be an integral multiple of the wavelength of radio waves at the target frequency (hereinafter referred to as a target wavelength). As long as the spacing D is sufficiently than the target wavelength, the specific value of the spacing D may be appropriately determined through simulation or experimentation (hereinafter, referred to as experimentation etc.). The spacing D is preferably at least 50 times smaller than the target wavelength. Further, as long as the width of the loop portion 50 is sufficiently smaller than the target wavelength, the specific value of that width may be appropriately designed.

In addition, the perimeter length of the loop portion 50 may be treated as an electrical length (i.e., a so called effective length). The electrical length is the length for radio waves and is determined based on the dielectric constant of the support portion 20 and the like.

The feed line 60 is a microstrip line provided on the patch surface of the support portion 20 in order to feed power to the loop portion 50. One end of the feed line 60 is electrically connected to the inner conductor of the coaxial cable and the other end of the feed line 60 is formed on the patch surface so as to be electromagnetically coupled with the loop portion 50. A current input from the feed line 60 propagates to the patch portion 30 via the loop portion 50 to excite the patch portion 30.

Further, if the spacing D between the loop portion 50 and the patch portion 30 is too large relative to the target wavelength, the inflow of current from the loop portion 50 to the patch portion 30 is reduced and the performance (for example, gain) of the antenna device 100 becomes degraded. For this reason, as described previously, the spacing D is preferably at least 50 times smaller than the target wavelength.

For the sake of convenience, hereinafter, the end portion of the feed line 60 toward the loop portion 50 will be referred to as a loop side end portion. In the loop portion 50, the point closest to the loop side end portion functions as a feed point 51. The present inventors have found through experimentations etc. that if the feed point 51 is provided at a point intersecting the sub patch center line on the outer edge portion 30A (hereinafter referred to as an outer edge intermediate point), the patch portion 30 does not excite well but the outer edge midpoint. Conversely, if the feed point 51 is provided at a point other than the outer edge intermediate point, it was confirmed that the desired performance may be achieved. Therefore, the feed point 51 is preferably provided at a position other than the outer edge intermediate point.

In particular, in a more preferable aspect of the present embodiment, the feed line 60 is formed such that the feed point 51 is near a boundary line between sub patch portions 31. This is to allow the current from the feed line 60 to flow into a plurality of sub patch portions 31.

The antenna device 100 described above may be used, for example, in a moving object such as a vehicle. When the antenna device 100 is used in a vehicle, the antenna device 100 is preferably disposed on a roof portion of the vehicle such that the ground plate 10 is substantially horizontal and a direction from the ground plate 10 to the patch portion 30 substantially coincides with the zenith direction.

The above described antenna device 100 may be designed by the following procedure, for example. First, the planar shape (including the size) of the patch portion 30 is provisionally determined according to the electrostatic capacitance that should be formed by the patch portion 30.

Next, based on the provisionally determined shape of the patch portion 30, the loop portion 50 is designed and the perimeter length of the loop portion 50 is calculated. Then, the size (e.g., inner diameter etc.) of the loop portion 50 is corrected such that the perimeter length of the loop portion 50 is an integral multiple of the target wavelength, and the shape of the patch portion 30 is corrected so as to form a desired spacing D.

Then, the thickness and the positions of the short circuit portion 40 are determined according to the corrected area of the patch portion 30. If the area of the patch portion 30 is known, since the electrostatic capacitance formed by the patch portion 30 is also known, the inductance that should be formed by the short circuit portion 40 is also known. The inductance to be formed by the short circuit portion 40 is a value that causes parallel resonance with the electrostatic capacitance formed by the patch portion 30 at the target frequency. Through such a process, the above described antenna device 100 can be manufactured.

Next, the operation of the antenna device 100 will be described. The operation of the antenna device 100 when transmitting radio waves and the operation of the antenna device 100 when receiving radio waves are mutually reversible. Therefore, as an example, the operation of radiating radio waves in each operation mode will be described, and descriptions of receiving radio waves will be omitted.

As described above, the patch portion 30 is short circuited to the ground plate 10 at the short circuit portion 40, and the area of the patch portion 30 is equal to an area for forming an electrostatic capacitance which parallel resonates at the target frequency with the inductance provided by the short circuit portion 40. For this reason, parallel resonance occurs due to energy exchange between the inductance and the electrostatic capacitance, and an electric field perpendicular to the ground plate 10 and the patch portion 30 is generated between the ground plate 10 and the patch portion 30.

In the antenna device 100, since the short circuit portion 40 is disposed at positions symmetrical about the patch center point 30C, the electric field traveling direction is the same direction in all areas viewed from the patch center point 30C (e.g., a direction from the patch center point 30C to the outer edge portion 30A). In addition, the strength of that electric field is zero in the vicinity of the short circuit portion 40, and is at a maximum value at the outer edge portion 30A.

That is, the intensity of the electric field generated between the ground plate 10 and the patch portion 30 increases in a direction from the short circuit portion 40 toward the outer edge portion 30A of the patch portion 30. In other words, the vertical electric field propagates from the short circuit portion 40 toward the outer edge portion 30A of the patch portion 30. Then, the vertical electric field becomes vertically polarized waves at the outer edge portion 30A and is radiated into space.

In other words, the antenna device 100 is omnidirectional for vertically polarized waves in all directions from the patch center point 30C toward the edge portions. Therefore, when the ground plate 10 is disposed so as to be horizontal, the antenna device 100 is omnidirectional in the horizontal plane Further, since the propagation direction of the electric field is symmetrical with respect to the patch center point 30C, the antenna device 100 has substantially the same gain in all directions along the horizontal plane.

Figure 5:
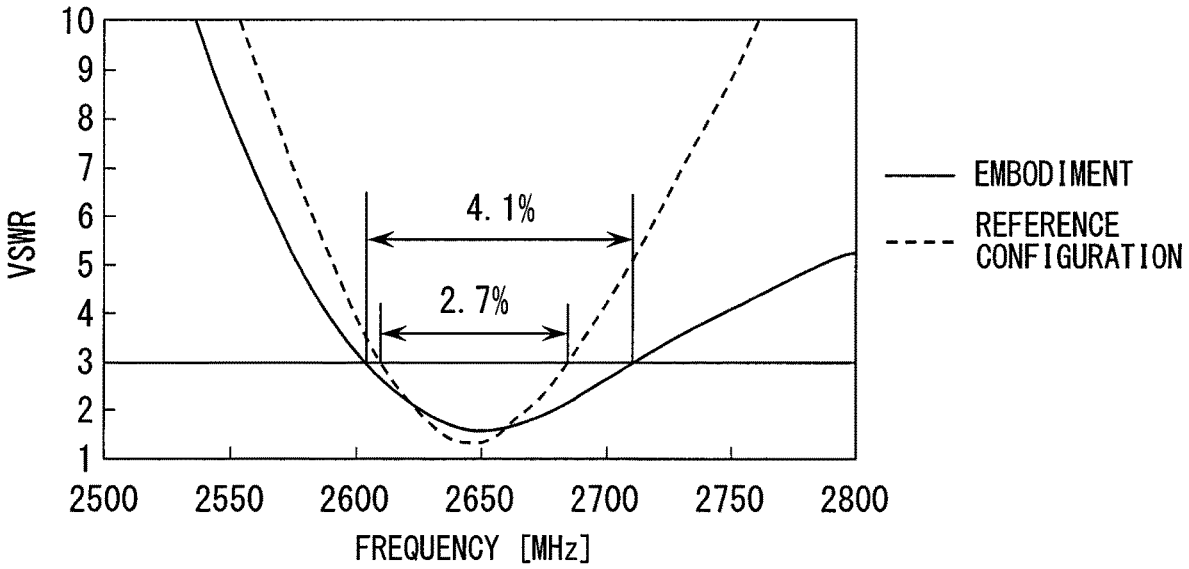
FIG. 5 is a graph showing a result of comparing VSWR for each frequency.

FIG. 5 is a graph showing the voltage standing wave ratio (VSWR: Voltage Standing Wave Ratio) for each frequency of the antenna device 100 of the present embodiment in comparison with the VSWR of a reference configuration.

The reference configuration here is a configuration in which the loop portion 50 is removed from the antenna device 100 of the present embodiment, while other configurations (for example, the size etc. of the patch portion 30) are the same.

As shown in FIG. 5, in the reference configuration, the operating band is 2.7%, whereas according to the configuration of the present embodiment, the operating band is 4.1%. That is, according to the configuration of the present embodiment, the operation band can be expanded. Further, the operation band range as used herein refers to a band in which the VSWR is 3 or less. In general, a range where VSWR is 3 or less is often regarded as frequencies with practical use possibilities.

In addition, since the above described antenna device 100 is an antenna device that operates on the same principles as the antenna device disclosed in Patent Literature 1 (that is, a parallel resonance type antenna device), the height of the antenna device 100 may be reduced (in other words, the thickness of the antenna device 100 may be reduced) as compared with a series resonance type antenna device (for example, a monopole antenna). That is, according to the above described embodiment, it is possible to achieve both reduction in thickness and broadening of the bandwidth of the antenna device.

Further, the reason why the operation band can be expanded by providing the loop portion 50 is contemplated to be as follows. By providing a plurality of short circuit portions 40 in the patch portion 30, the patch portion 30 is virtually divided into a plurality of regions (i.e., the sub patch portions 31).

As a result, at a certain frequency, the sub patch portions 31 relatively far from the feed point 51 are excited to a lesser degree, and the electric field is distributed in fewer regions in the patch portion 30. In other words, at a certain frequency, the plurality of sub patch portions 31 which are relatively close to the feed point 51 are combined to function as a single patch portion.

Naturally, the area of a region formed by combining a subset of the sub patch portions 31 is smaller than the area of the original patch portion 30. Accordingly, the amount of electrostatic capacitance contributing to parallel excitation decreases, such that parallel resonance occurs at a frequency shifted from the target frequency.

Here, when a feed point is provided at the outer edge portion 30A of the patch portion 30 without passing through a loop portion 50 as in the reference configuration, a relatively strong current flows into the patch portion 30. As a result, a relatively tight electromagnetic coupling is effected between mutual ones of the sub patch portions 31, and it is unlikely for excitation to occur at frequencies shifted from the target frequency. Conversely, in the present embodiment, the current from the feed line 60 is dispersed and flows into the patch portion 30. As a result, as compared with the reference configuration, the coupling between the sub patch portions 31 becomes relatively weak, and excitation tends to occur even at frequencies which deviate from the target frequency.

Of course, since the loop portion 50, which plays a role of supplying current to the patch portion 30, is disposed outward of all sub patch portions 31, operation also occurs when all the sub patch portions 31 are coupled. That is, operation also occurs at a frequency corresponding to the area of the patch portion 30. Here, a region defined by the sub patch portions 31 being coupled to each other refers to a region in which a relatively strong electric field is distributed.

Further, when the loop portion 50 supplies power to the plurality of sub patch portions 31 as a transmission line, the loop portion 50 may be considered to be contributing to aligning the phase differences between adjacent sub patch portions 31 to the same phase, or conferring an appropriate phase difference to each sub patch portion 31 such that the radiation gain of the entire patch portion 30 improves.

Although an embodiment of the present disclosure has been described above, the present disclosure is not limited to the above-described embodiment, and various modifications described below are also included in the technical scope of the present disclosure. In addition, various modifications are contemplated within a range not deviating from the gist of the present disclosure, a described below.

Further, members having the same functions as the members described in the above embodiment are denoted by the same reference numerals, and description thereof is omitted. Further, when only a partial configuration is described, the configuration of the above-described embodiment can be applied to the other portions.

First Modified Example

Figure 6:
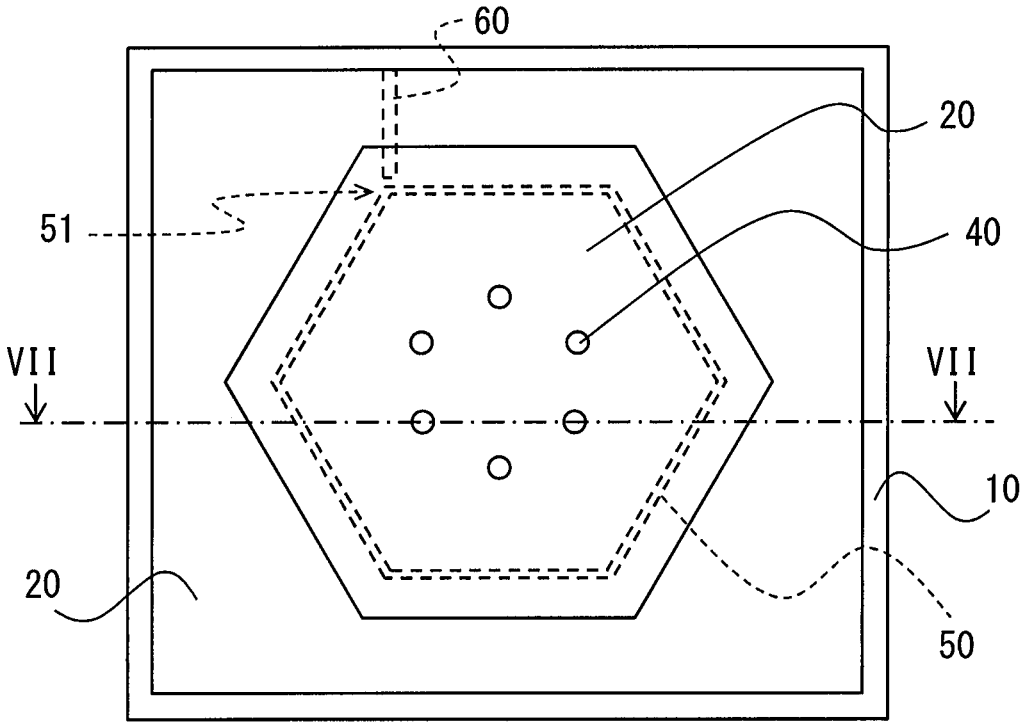
FIG. 6 is a top view of an antenna device 100.
Figure 7:
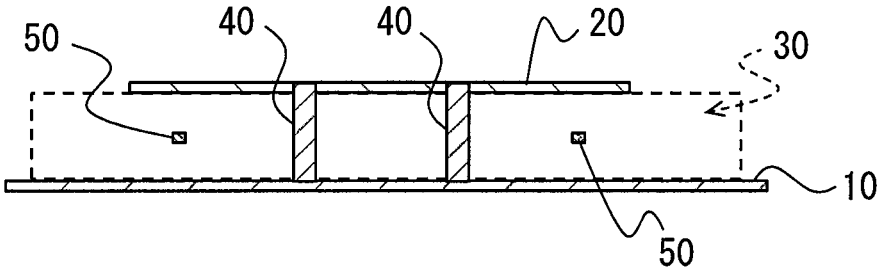
FIG. 7 is a cross-sectional view of an antenna device 100 taken along the line VII-VII shown in FIG. 6.

In the above-described embodiment, an exemplary aspect is described in which the loop portion 50 is provided on the surface as the patch portion 30, but this is not limiting. For example, the loop portion 50 may be arranged on a plane parallel to the patch portion 30 so as to form a predetermined spacing D with the outer edge portion 30A of the patch portion 30. FIGS. 6 and 7 are examples of configurations corresponding to the idea disclosed as this First Modified Example, and show a configuration in which the loop portion 50 is provided on a plane in between the patch portion 30 and the ground plate 10.

Further, in FIGS. 6 and 7, an example is shown in which the loop portion 50 is formed so as to be located inward of the outer edge portion 30A from a top view (in other words, closer toward the patch center point 30C), but this is not limiting. The loop portion 50 may instead be formed so as to be located outward of the outer edge portion 30A from a top view. Further, in FIGS. 6 and 7, an exemplary aspect is shown in which the loop portion 50 is disposed on a plane closer to the ground plate 10 than the patch portion 30, but this is not limiting. The loop portion 50 may be arranged on a plane on the side where the ground plate 10 does not exist as viewed from the patch portion 30. That is, the loop portion 50 may be disposed above the patch portion 30.

However, it is necessary for the loop portion 50 and the patch portion 30 to be strongly electromagnetically coupled. Therefore, it is preferable that the loop portion 50 is provided on the same plane in which the patch portion 30 is provided, or in a parallel plane which is sufficiently close to strongly couple the loop portion 50 to the patch portion 30.

Second Modified Example

Figure 8:
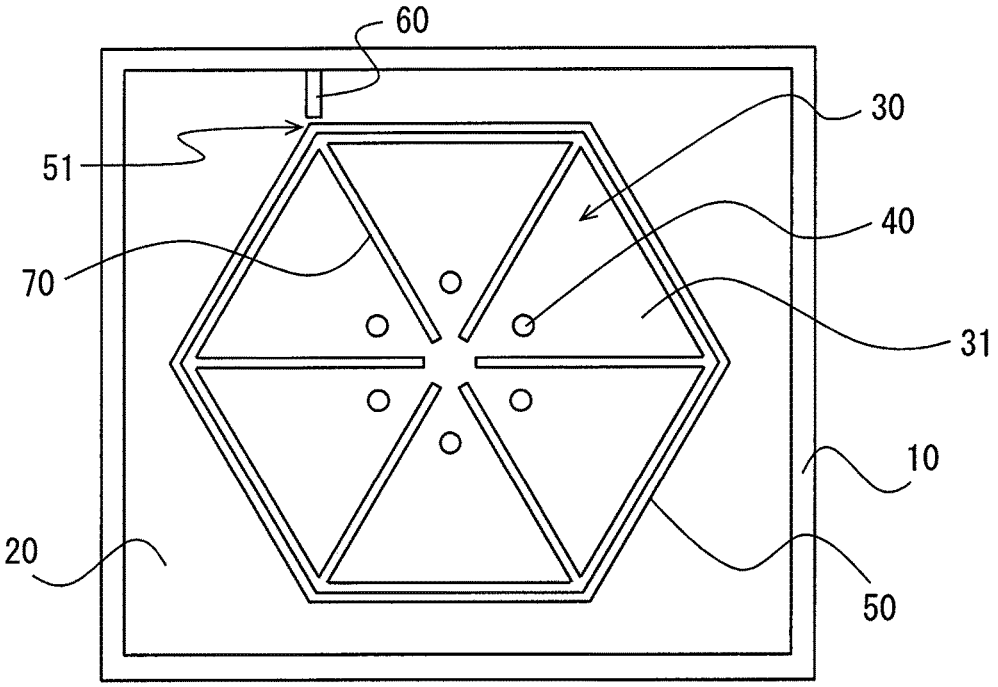
FIG. 8 is a top view of an antenna device 100.

As shown in FIG. 8, the patch portion 30 may be provided with slit portions 70 which are cut along the boundary lines of the sub patch portions 31 to extend from the outer edge portion 30A toward the patch center point 30C. Such a configuration is referred to as a second modified example.

One end of each slit portion 70 is connected to the gap between the loop portion 50 and the patch portion 30. The end portion of each slit portion 70 located toward the patch center point is referred to as a center side end portion for the sake of convenience. The length of the slit portion 70 is arbitrary. However, in the configuration of this second modified example, the distance between the center side end portion and the patch center point is set to be equal to or greater than 1/100 of the target wavelength such that each sub patch portion 31 is not physically separated from other sub patch portions 31. As a result, each sub patch portion 31 is connected to each other near the patch center point.

Figure 9:
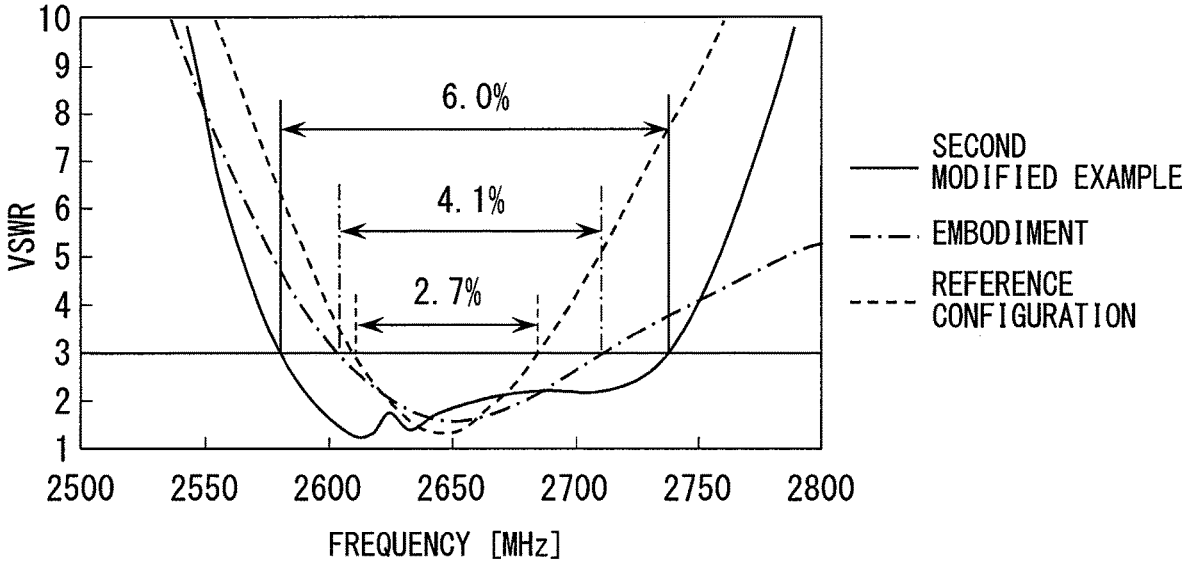
FIG. 9 is a graph showing a result of comparing VSWR for each frequency.

FIG. 9 is a graph for explaining the effects of providing the slit portions 70, and is a graph showing the VSWR for each frequency in an antenna device adopting the respective configurations of the second modified example, the embodiment, and the reference configuration. The dotted line in the figure represents VSWR in the reference configuration, the dot-dash chain line represents VSWR in the embodiment, and the solid line represents VSWR in the second modified example.

As shown in FIG. 9, according to the configuration of the second modified example, the operation band can be expanded further than in the embodiment. Specifically, operation can be performed with a twice or greater operation band as compared with the reference configuration. This is because by providing the slit portions 70 on the boundary lines of the sub patch portions 31, the coupling between the sub patch portions 31 becomes sparse as compared with the embodiment, and it is easier for different combinations of sub patch portions 31 to operate depending on frequency.

Figure 10:
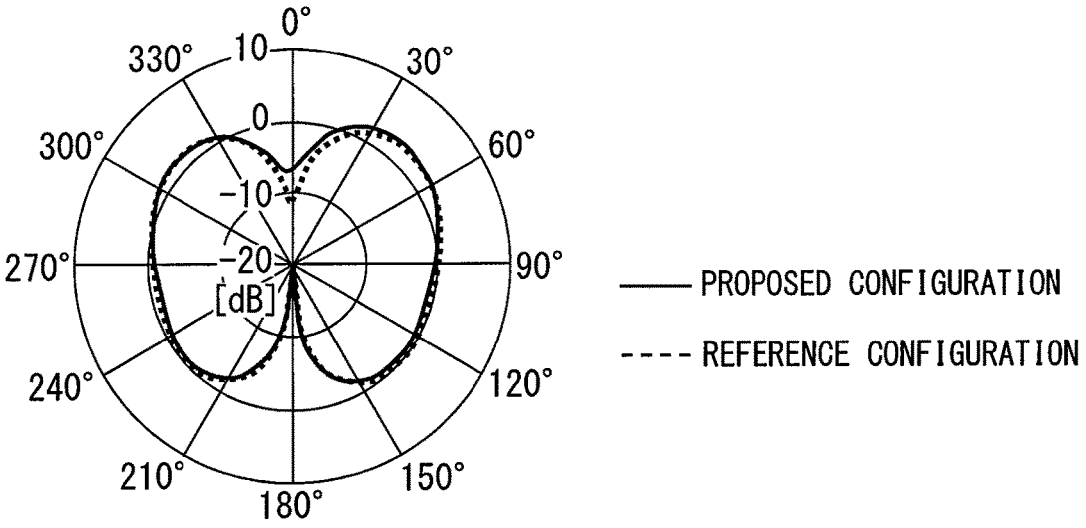
FIG. 10 is a diagram showing directivity of an antenna device 100 in the vertical direction.
Figure 11:
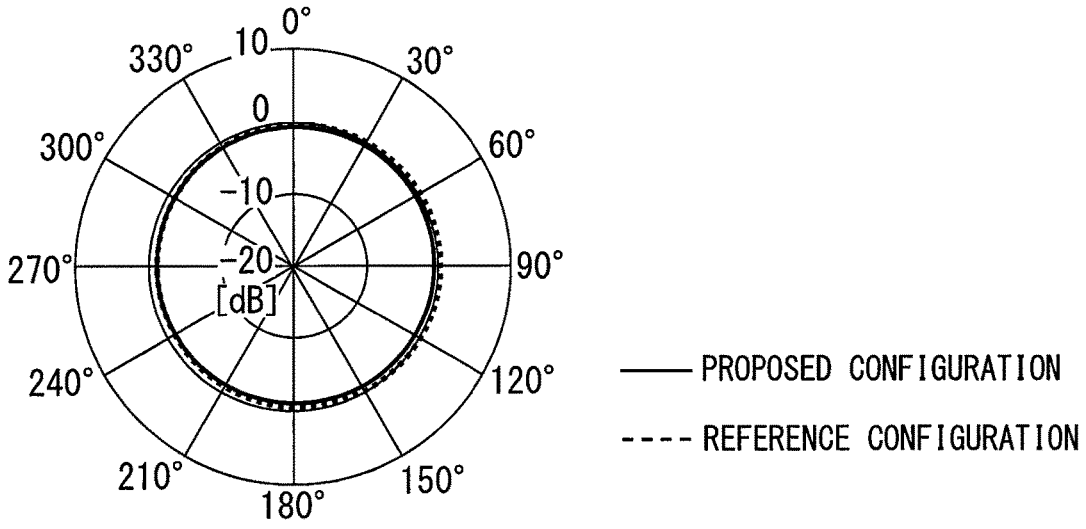
FIG. 11 is a diagram showing directivity of an antenna device 100 in the horizontal direction.

FIG. 10 shows directivity in the vertical direction for the antenna device 100 of the second modified example, and FIG. 11 shows directivity in the horizontal direction for the antenna device 100 of the second modified example. The dotted line in each figure shows directivity of the reference configuration and the solid line shows directivity according to the configuration of the second modified example.

As shown in FIG. 10 and FIG. 11, omnidirectional radiation of vertically polarized waves in the horizontal plane equivalent to the reference configuration can be obtained. Further, the vertical direction as used here is a direction from the ground plate 10 to the patch portion 30, and the horizontal direction is a direction from the patch center portion toward the outer edge portion 30A. Although diagrams showing directivity in the configuration of the embodiment are omitted, omnidirectional radiation of vertically polarized waves in the horizontal plane equivalent to the reference configuration is obtained also in the embodiment.

Third Modified Example

Figure 12:
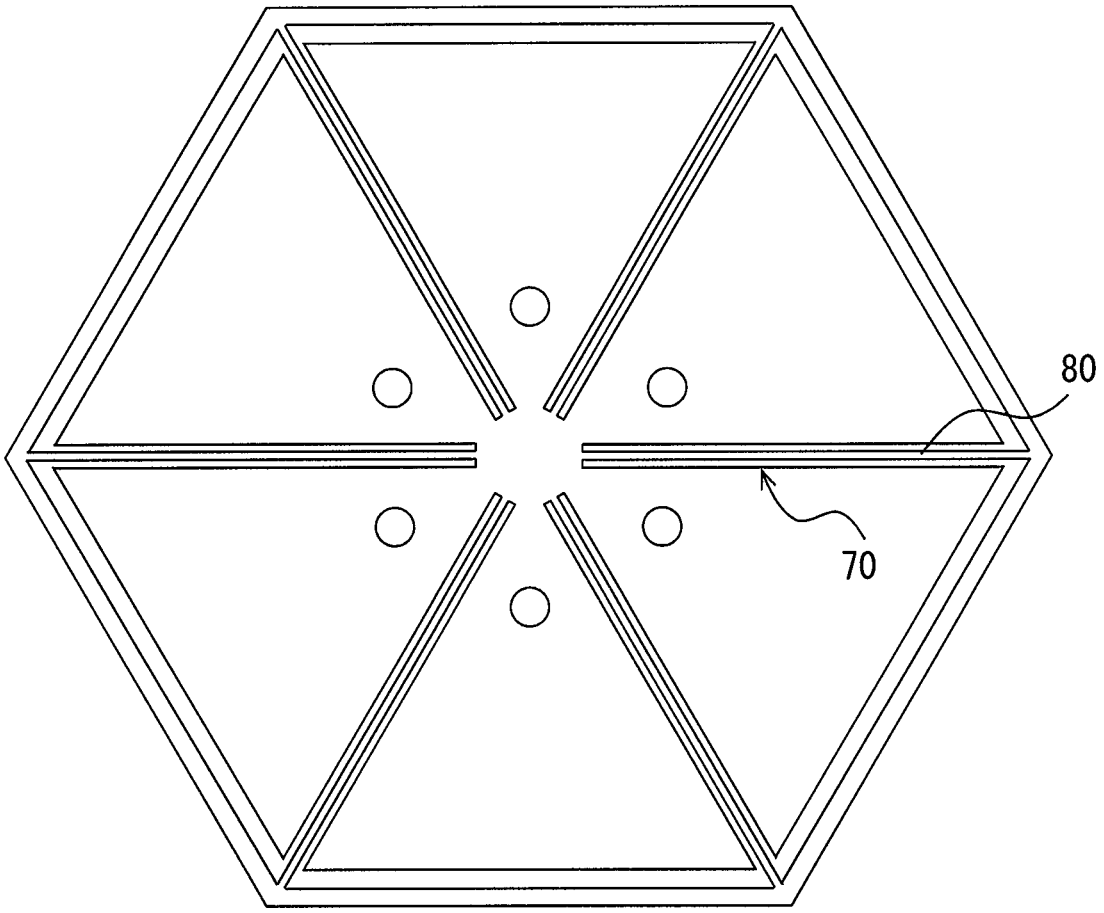
FIG. 12 is a top view of an antenna device 100.

As shown in FIG. 12, a linear conductor member (hereinafter referred to as a linear element) 80 extending from the loop portion 50 toward the patch center point 30C may be provided on the center of each slit portion 70 introduced in the second modified example. Further, the center line of the slit portions 70 corresponds to the boundary lines of the sub patch portions 31. In other words, the center line is a line that is parallel to the length direction of the slit portion 70 and that bisects the width of the slit portion 70.

On the center line of each slit portion 70, the linear element 80 is formed such that one end is connected to the loop portion 50 and the other end is connected to the patch portion 30 in the vicinity of the patch center point. In other words, the linear element 80 electrically connects the area near the patch center point of the patch portion 30 to the loop portion 50, and weakens the capacitive coupling between the sub patch portions 31. The current flowing into the loop portion 50 flows not only from the loop portion 50 but also from the linear elements 80 to the sub patch portions 31.

That is, according to the configuration of the third modified example, the current from the feed point 51 is more easily supplied to the sub patch portions 31. Therefore, the upper limit value of the spacing D between the loop portion 50 and the patch portion 30 can be increased as compared to the embodiment. In other words, restrictions on the spacing D between the loop portion 50 and the patch portion 30 can be relaxed.

Fourth Modified Example

Figure 13:
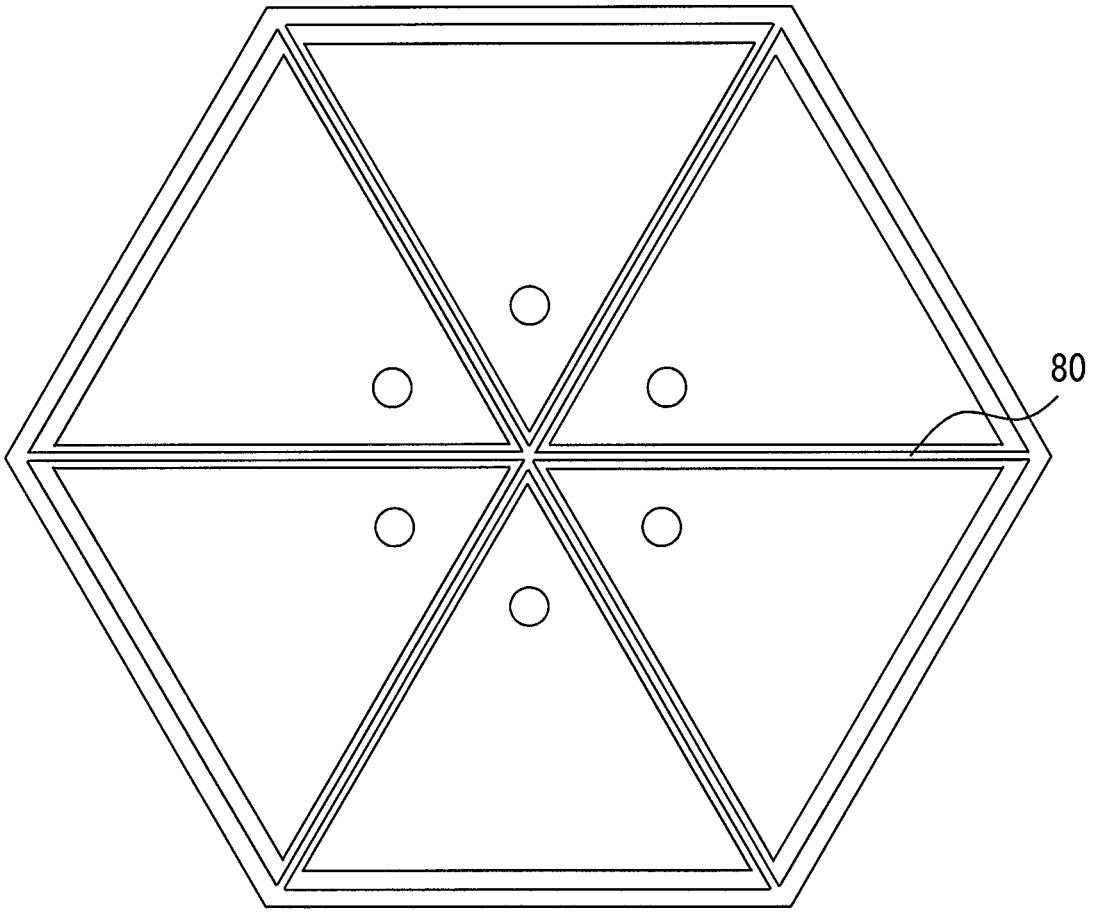
FIG. 13 is a top view of an antenna device 100.

FIG. 13 shows a further modification of the third modified example, in which each slit portion 70 is extended until it is connected to the other slit portions 70, and each sub patch portion 31 is separated from the other sub patch portions 31. That is, the areas obtained by physically dividing the patch portion 30 function as the sub patch portions 31.

In the case where the linear elements 80 are provided inside the slit portions 70, even if each sub patch portion 31 is separated from the other sub patch portions 31 as shown in FIG. 13, operation is the same as in the above-described second modified example etc.

Fifth Modified Example

In the above-described embodiment and various modified examples, the planar shape of the patch portion 30 is a regular hexagon, but this is not limiting. As shown in FIGS. 14 to 18, various shapes can be adopted. In accordance with this, the sub patch portions 31 can adopt various shapes as well. In FIG. 14 to FIG. 18, illustration of the ground plate 10 is omitted.

Figure 14:
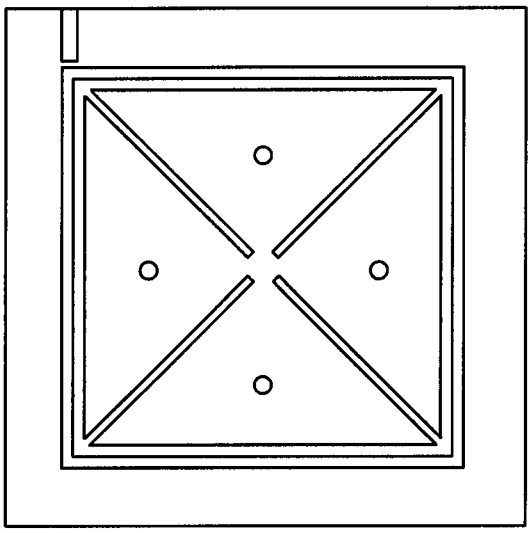
FIG. 14 is a diagram showing a modified example of a patch portion 30.
Figure 15:
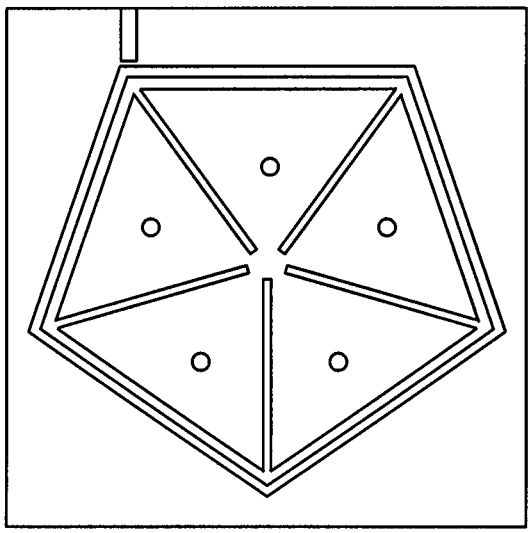
FIG. 15 is a diagram showing a modified example of a patch portion 30.

FIG. 14 shows a configuration in which the planar shape of the patch portion 30 is a square shape and the patch portion 30 is divided into four sub patch portions 31 by the diagonal of that square shape. FIG. 15 shows a configuration in which the planar shape of the patch portion 30 is a regular pentagon and the patch portion 30 is divided into five sub patch portions 31 by lines extending from the center of the regular pentagon toward each vertex of the regular pentagon.

Figure 16:
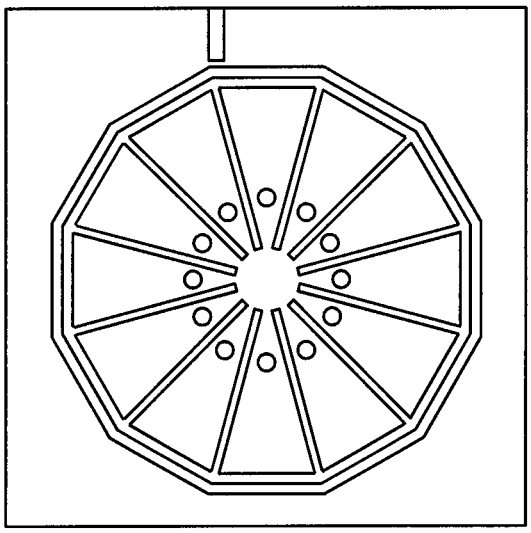
FIG. 16 is a diagram showing a modified example of a patch portion 30.
Figure 17:
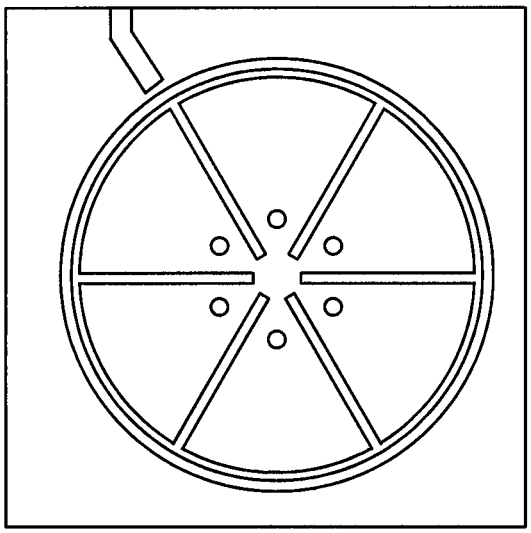
FIG. 17 is a diagram showing a modified example of a patch portion 30.

FIG. 16 shows a configuration in which the planar shape of the patch portion 30 is a regular dodecagon and the patch portion 30 is divided into twelve sub patch portions 31 by lines extending from the center of the regular dodecagon to each vertex of the regular dodecagon. FIG. 17 shows a configuration in which the planar shape of the patch portion 30 is circular and the patch portion 30 is divided into six equally sized sub patch portions 31 by using straight lines passing through the center of the circle.

Figure 18:
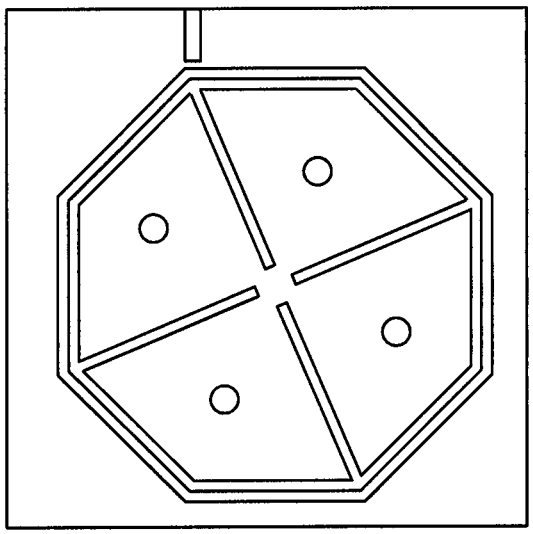
FIG. 18 is a diagram showing a modified example of a patch portion 30.

FIG. 18 shows a configuration in which the planar shape of the patch portion 30 is a regular octagon and the patch portion 30 is divided into four equally sized sub patch portions 31 by straight lines extending from the center of the regular octagon to the outer edge portion 30A.

In any of these configurations, the patch portion 30 has a shape corresponding to at least one of a point-symmetric shape about the patch center point 30C or a line-symmetric shape about a straight line passing through the patch center point 30C. Further, the shape of the patch portion 30 is not limited to the above-described shapes. For example, it may be an elliptical shape or the like. Various shapes can be used for the shape of the patch portion 30. In accordance with this, the sub patch portions 31 can have various shapes as well. However, the spacing D between the patch portion 30 and the loop portion 50 is set to satisfy the above-mentioned conditions.

Figure 19:
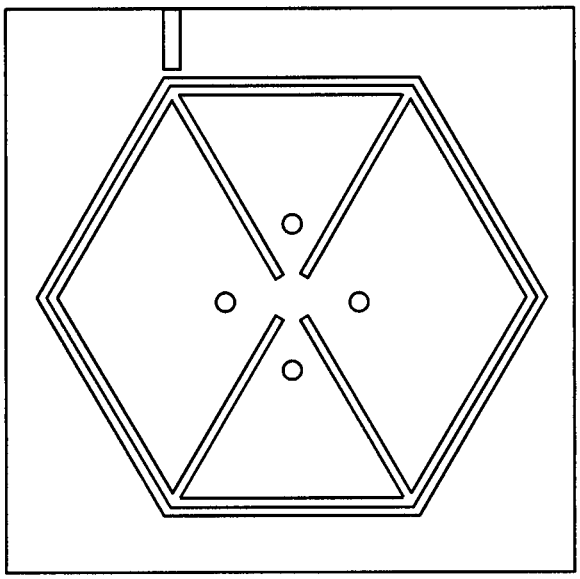
FIG. 19 is a diagram showing a modified example of a patch portion 30.

Further, the shapes of the plurality of sub patch portions 31 are not necessarily all the same. Each sub patch portion 31 may be formed such that another sub patch portion 31 exists at a position which is line symmetric about a straight line passing through the patch center point 30C or at a point symmetric position with the patch center point 30C as the symmetry center. For example, as shown in FIG. 19, two pairs of sub patch portions 31 having different sizes may be set.

Further, each of FIGS. 14 to 18 illustrate a configuration in which the slit portions 70 are provided as in the second modified example, but the slit portion 70 may be not provided as in the embodiment instead. Further, as in the third modified example, the linear elements 80 may be provided as well.

In addition, though various shapes and division numbers have been provided as examples above, the inventors have found that, in order to broaden the operating band of the antenna device 100 as compared to the reference configuration, the patch portion 30 is preferably divided to include five or more sub patch portions 31. When the number of sub patch portions 31 is four or less, it is thought that the coupling between the sub patch portions 31 is strong because the division number is relatively small, and so it is difficult to form operation regions in the patch portion 30.

Sixth Modified Example

Figure 20:
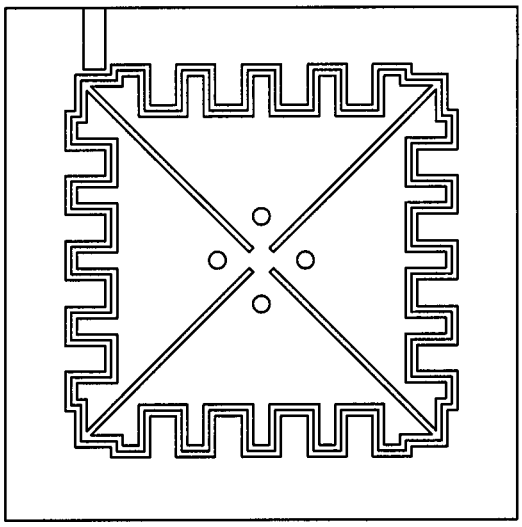
FIG. 20 is a top view of an antenna device 100.

The outer edge portion 30A of the patch portion 30 may have a meandering shape as shown in FIG. 20. Further, it may has a waveform shape as well. The loop portion 50 should be formed to face the outer edge portion 30A at the particular spacing D.

Other Modified Examples

In the above description, exemplary aspects are provided in which the antenna device 100 is an unbalanced feed type antenna device, but this is not limiting. The ground plate 10 may be made to have the same shape as that of the patch portion 30 so as to operate as a balanced feed type antenna.

Further, in the above description, exemplary aspects are provided in which power is supplied to the loop portion 50 and the patch portion 30 by electromagnetic coupling (mainly capacitive coupling) between the feed line 60 and the loop portion 50, but this is not limiting. As the power supply system, a direct-coupling power supply system may be used. Further, in the above description, the perimeter length of the loop portion 50 is set to be an integral multiple of the target wavelength. However, the perimeter length of the loop portion 50 may be formed to be an integral multiple of half of the target wavelength as well.

What is claimed is:

1. An antenna device, comprising:

a ground plate which is a flat plate shaped conductor member;

a patch portion which is a flat plate shaped conductor member disposed in parallel with the ground plate to face the ground plate, the patch portion being spaced away from the ground plate by a particular spacing;

a plurality of short circuit portions that electrically connects the patch portion to the ground plate; and a loop portion which is a loop shaped conductor member arranged on a plane parallel to the ground plate so as to be spaced away from an outer edge portion of the patch portion by a particular spacing, wherein a feed point electrically connected to a feed line is disposed in the loop portion, the patch portion has an area which forms an electrostatic capacitance that causes parallel resonance with an inductance provided by the short circuit portions at a particular target frequency, the loop portion is a closed-loop shape, and the loop portion and the patch portion are disposed in a same plane.

2. The antenna device of claim 1, wherein the patch portion has a planar shape which is, or is based on, a shape that is line symmetrical about a straight line passing through a patch center point or point symmetrical about the patch center point as a symmetry center, the patch center point being a point at a center of the patch portion.

3. The antenna device of claim 2, wherein the patch portion is virtually or physically divided into a plurality of sub patch portions, each of the plurality of sub patch portions is arranged at a position in the patch portion such that another one of the plurality of sub patch portions exists at a position which is line symmetrical about a straight line passing through the patch center point or point symmetrical about the patch center point as a center of symmetry, and the short circuit portions are provided in each of the plurality of sub patch portions.

4. The antenna device of claim 3, wherein the patch portion is provided with a slit portion which is a portion cut out in a straight line shape on a boundary line of the sub patch portions, the slit portion having a particular length in a direction from the outer edge portion toward the patch center point.

5. The antenna device of claim 4, wherein a linear element, which is a linear conductor member connecting the loop portion to the patch portion, is provided on a center line of the slit portion.

6. The antenna device of claim 3, wherein each of the plurality of sub patch portions is electrically connected to each other in a region on toward where the patch center point is located.

7. The antenna device of claim 3, wherein the sub patch portions are formed by physically dividing the patch portion such that each of the sub patch portions is spaced away from other ones of the sub patch portions by a particular spacing, linear elements extending from the loop portion toward the patch center point are provided between the sub patch portions, and the linear elements are connected to each other at the patch center point.

8. The antenna device of claim 3, wherein the feed point is implemented by electromagnetic coupling between the loop portion and a microstrip line electrically connected to the feed line.

9. The antenna device of claim 3, wherein the feed point is provided at a position on a line that extends from a boundary line of the sub patch portions in the loop portion.

10. The antenna device of claim 3, wherein the ground plate has a same shape as the patch portion to operate as a balanced feed type antenna.

11. An antenna device, comprising:

a ground plate which is a flat plate shaped conductor member;

a patch portion which is a flat plate shaped conductor member disposed in parallel with the ground plate to face the ground plate, the patch portion being spaced away from the ground plate by a particular spacing;

a plurality of short circuit portions that electrically connects the patch portion to the ground plate; and a loop portion which is a loop shaped conductor member arranged on a plane parallel to the ground plate so as to be spaced away from an outer edge portion of the patch portion by a particular spacing, wherein a feed point electrically connected to a feed line is disposed in the loop portion, the patch portion has an area which forms an electrostatic capacitance that causes parallel resonance with an inductance provided by the short circuit portions at a particular target frequency the patch portion has a planar shape which is, or is based on, a shape that is line symmetrical about a straight line passing through a patch center point or point symmetrical about the patch center point as a symmetry center, the patch center point being a point at a center of the patch portion, the patch portion is virtually or physically divided into a plurality of sub patch portions, each of the plurality of sub patch portions is arranged at a position in the patch portion such that another one of the plurality of sub patch portions exists at a position which is line symmetrical about a straight line passing through the patch center point or point symmetrical about the patch center point as a center of symmetry, the short circuit portions are provided in each of the plurality of sub patch portions, and the patch portion is provided with a slit portion which is a portion cut out in a straight line shape on a boundary line of the sub patch portions, the slit portion having a particular length in a direction from the outer edge portion toward the patch center point.

12. An antenna device, comprising:

a ground plate which is a flat plate shaped conductor member;

a patch portion which is a flat plate shaped conductor member disposed in parallel with the ground plate to face the ground plate, the patch portion being spaced away from the ground plate by a particular spacing;

a plurality of short circuit portions that electrically connects the patch portion to the ground plate; and a loop portion which is a loop shaped conductor member arranged on a plane parallel to the ground plate so as to be spaced away from an outer edge portion of the patch portion by a particular spacing, wherein a feed point electrically connected to a feed line is disposed in the loop portion, the patch portion has an area which forms an electrostatic capacitance that causes parallel resonance with an inductance provided by the short circuit portions at a particular target frequency the patch portion has a planar shape which is, or is based on, a shape that is line symmetrical about a straight line passing through a patch center point or point symmetrical about the patch center point as a symmetry center, the patch center point being a point at a center of the patch portion, the patch portion is virtually or physically divided into a plurality of sub patch portions, each of the plurality of sub patch portions is arranged at a position in the patch portion such that another one of the plurality of sub patch portions exists at a position which is line symmetrical about a straight line passing through the patch center point or point symmetrical about the patch center point as a center of symmetry, the short circuit portions are provided in each of the plurality of sub patch portions, the sub patch portions are formed by physically dividing the patch portion such that each of the sub patch portions is spaced away from other ones of the sub patch portions by a particular spacing, linear elements extending from the loop portion toward the patch center point are provided between the sub patch portions, and the linear elements are connected to each other at the patch center point.

13. An antenna device, comprising:

a ground plate which is a flat plate shaped conductor member;

a patch portion which is a flat plate shaped conductor member disposed in parallel with the ground plate to face the ground plate, the patch portion being spaced away from the ground plate by a particular spacing;

a plurality of short circuit portions that electrically connects the patch portion to the ground plate; and a loop portion which is a loop shaped conductor member arranged on a plane parallel to the ground plate so as to be spaced away from an outer edge portion of the patch portion by a particular spacing, wherein a feed point electrically connected to a feed line is disposed in the loop portion, the patch portion has an area which forms an electrostatic capacitance that causes parallel resonance with an inductance provided by the short circuit portions at a particular target frequency the patch portion has a planar shape which is, or is based on, a shape that is line symmetrical about a straight line passing through a patch center point or point symmetrical about the patch center point as a symmetry center, the patch center point being a point at a center of the patch portion, the patch portion is virtually or physically divided into a plurality of sub patch portions, each of the plurality of sub patch portions is arranged at a position in the patch portion such that another one of the plurality of sub patch portions exists at a position which is line symmetrical about a straight line passing through the patch center point or point symmetrical about the patch center point as a center of symmetry, the short circuit portions are provided in each of the plurality of sub patch portions, and the feed point is provided at a position on a line that extends from a boundary line of the sub patch portions in the loop portion.

* * * * *